US012188698B2

(12) United States Patent
Kim et al.

(10) Patent No.: US 12,188,698 B2
(45) Date of Patent: Jan. 7, 2025

(54) AIR CONDITIONING DEVICE

(71) Applicant: Samsung Electronics Co., Ltd., Suwon-si (KR)

(72) Inventors: Munsub Kim, Suwon-si (KR); Hyeongjin Lee, Suwon-si (KR); Duhan Jung, Suwon-si (KR); Jaewoo Choi, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 152 days.

(21) Appl. No.: 17/886,654

(22) Filed: Aug. 12, 2022

(65) Prior Publication Data

US 2023/0160614 A1 May 25, 2023

Related U.S. Application Data

(63) Continuation of application No. PCT/KR2022/008871, filed on Jun. 22, 2022.

(30) Foreign Application Priority Data

Nov. 19, 2021 (KR) ..... 10-2021-0160714

(51) Int. Cl.
*F25B 41/40* (2021.01)
*F25B 39/00* (2006.01)
*F25B 41/37* (2021.01)

(52) U.S. Cl.
CPC ..... *F25B 41/40* (2021.01); *F25B 39/00* (2013.01); *F25B 41/37* (2021.01); *F25B 2500/01* (2013.01)

(58) Field of Classification Search
CPC ..... F25B 41/40; F25B 41/37; F25B 39/00; F25B 2500/01; F25B 2500/12; F24F 1/0068; F24F 13/24
See application file for complete search history.

(56) References Cited

U.S. PATENT DOCUMENTS 5,214,939 A 6/1993 Drucker et al.
6,170,289 B1 1/2001 Brown et al.
(Continued)

FOREIGN PATENT DOCUMENTS

CN 2597910 Y * 1/2004 ..... F25B 41/37
CN 104110538 A 10/2014
(Continued)

OTHER PUBLICATIONS

International Search Report with Written Opinion dated Oct. 4, 2022 issue in PCT Application No. PCT/KR2022/008871.
(Continued)

*Primary Examiner* — Emmanuel E Duke
(74) *Attorney, Agent, or Firm* — STAAS & HALSEY LLP

(57) ABSTRACT

An air conditioning device including a condenser configured to condense a refrigerant gas into a liquid refrigerant, an evaporator configured to phase-change the liquid refrigerant introduced from the condenser into a vapor refrigerant, a refrigerant inlet pipe connected to the evaporator and into which a refrigerant is introduced from the condenser, a capillary tube fully inserted into the refrigerant inlet pipe, and a clamping portion depressed a part of the refrigerant inlet pipe and a part of the capillary tube corresponding to the depressed part of the refrigerant inlet pipe to fix the capillary tube inside the refrigerant inlet pipe.

18 Claims, 7 Drawing Sheets

(56) References Cited

U.S. PATENT DOCUMENTS

| | | | | |
|---|---|---|---|---|
| 6,199,399 | B1 | 3/2001 | Voorhis | |
| 2010/0037629 | A1 | 2/2010 | Voorhis | |
| 2020/0049391 | A1 * | 2/2020 | Kim | F25B 41/40 |

FOREIGN PATENT DOCUMENTS

| | | | | | |
|---|---|---|---|---|---|
| EP | 0520309 | A1 | * | 1/1996 | |
| GB | 2143014 | A | * | 1/1985 | F25B 41/067 |
| GB | 2597910 | A | * | 2/2022 | F16G 13/02 |
| JP | H05322376 | A | * | 12/1993 | |
| JP | 7-167533 | | | 7/1995 | |
| JP | H1078270 | A | * | 3/1998 | F25B 41/37 |
| JP | 3432701 | B2 | | 5/2003 | |
| JP | 6962764 | | | 11/2021 | |
| KR | 10-2001-0046009 | | | 6/2001 | |
| KR | 20-0283926 | | | 10/2002 | |
| KR | 20030041700 | A | * | 5/2003 | F25B 41/325 |
| KR | 10-2004-0106175 | A | | 12/2004 | |
| KR | 20050029567 | A | * | 3/2005 | |
| KR | 10-2005-0077857 | A | | 8/2005 | |
| KR | 100568244 | B1 | * | 4/2006 | F25B 41/37 |
| KR | 10-2011-0045132 | A | | 5/2011 | |
| KR | 10-2016-0020313 | | | 2/2016 | |
| KR | 10-1976037 | | | 8/2019 | |
| KR | 10-2020-0019047 | | | 2/2020 | |
| WO | WO-2012043804 | A1 | * | 4/2012 | F25B 39/02 |

OTHER PUBLICATIONS

Written Opinion dated Oct. 4, 2022 issue in PCT Application No. PCT/KR2022/008871.

Supplementary Partial European Search Report dated Nov. 14, 2024 issued in European Application No. EP 22 89 5772.

* cited by examiner

AIR CONDITIONING DEVICE

CROSS-REFERENCE RELATED APPLICATION

This application is a continuation application, based on and claims priority under 35 USC § 111 (a), of International Application No. PCT/KR2022/008871, filed on Jun. 22, 2022, which claims priority to U. S. C. § 119 to Korean Patent Application Nos. 10-2021-0160714 filed on Nov. 19, 2021, the disclosure of which are incorporated herein by reference in its entirety.

BACKGROUND

Field

The disclosure relates to an air conditioning device.

Description of Related Art

An air conditioning device includes a compressor, a heat exchanger (a condenser or an evaporator), an expansion valve, and an air blower. The air conditioning device may be divided into an indoor unit and an outdoor unit. In this case, the outdoor unit may include a compressor, a condenser, and an air blower, and the indoor unit may include an evaporator and an air blower. The expansion valve may differ depending on a structure of an air conditioning system. Still, the expansion valve is mainly built in the outdoor unit due to an installation space. For an inverter compressor system, the expansion valve employs an electronic expansion valve to control an optimum expansion amount of refrigerant according to a flow rate of air. A high-pressure refrigerant gas discharged from an inverter compressor changes into a high-pressure liquid refrigerant state in the condenser. The liquid refrigerant expands while passing through a nozzle of the electronic expansion valve and becomes a two-phase refrigerant (a gas-liquid mixed refrigerant). The expanded gas-liquid mixed refrigerant is supplied to the evaporator of the indoor unit along a pipe connecting the outdoor unit with the indoor unit.

When there is a flow disturbance factor such as a rapid cross-sectional change in the pipe in which the two-phase refrigerant flows, high flow noise is likely to occur. In particular, recently, the pipe connecting the outdoor unit to the indoor unit is often buried in the floor or wall during house construction, and flow disturbance factors such as a difference in diameter between the buried pipe and the pipe of the air conditioning device, bending of the buried pipe, etc., are likely to arise.

SUMMARY

According to an embodiment of the disclosure, an air conditioning device includes a condenser configured to condense a refrigerant gas into a liquid refrigerant, an evaporator configured to phase-change the liquid refrigerant introduced from the condenser into a vapor refrigerant, a refrigerant inlet pipe connected to the evaporator and into which a refrigerant is introduced from the condenser, a capillary tube fully inserted into the refrigerant inlet pipe, and a clamping portion depressed a part of the refrigerant inlet pipe and a part of the capillary tube corresponding to the depressed part of the refrigerant inlet pipe to fix the capillary tube inside the refrigerant inlet pipe.

According to an embodiment of the disclosure, the capillary tube may include an expansion portion having an expanded diameter, and the expansion portion includes the depressed part of the capillary tube which corresponds to the depressed part of the clamping portion.

According to an embodiment of the disclosure, an inner diameter of the depressed part of the expansion portion which is depressed by the clamping portion may be greater than or equal to an inner diameter of the capillary tube.

According to an embodiment of the disclosure, a buffering material may be arranged between the refrigerant inlet pipe and the capillary tube.

According to an embodiment of the disclosure, the refrigerant inlet pipe may include at least one bending portion that is bent together with the capillary tube.

According to an embodiment of the disclosure, a buffering material may be arranged between the refrigerant inlet pipe and the capillary tube in the at least one bending portion.

According to an embodiment of the disclosure, the capillary tube may is made of a flexible material. The air conditioning device may include a shape retention pipe including a large-diameter portion inserted into the refrigerant inlet pipe, and contacting an inner side of the refrigerant pipe, a small-diameter portion inserted into an end portion of the capillary tube to fix the capillary tube to the inner side of the refrigerant inlet pipe, and a connection portion connecting the large-diameter portion to the small-diameter portion. The depressed part of the refrigerant inlet pipe and the depressed part of the capillary tube are in a position corresponding to the small-diameter portion to fix the capillary tube inside the refrigerant inlet pipe.

According to an embodiment of the disclosure, the refrigerant inlet pipe may include a first portion including the capillary tube inserted therein and a second portion connected to the first portion and provided with a first connection member connected to the first connection pipe into which the refrigerant from the condenser flows.

According to an embodiment of the disclosure, a natural potential of the second portion may have a value between a natural potential of the first portion and a natural potential of the first connection member.

According to another embodiment of the disclosure, an air conditioning device includes an outdoor unit including a compressor configured to compress a vapor refrigerant to a high-pressure vapor refrigerant, a condenser configured to condense the compressed high-pressure vapor refrigerant to a liquid refrigerant, and a flow control valve configured to control a flow rate of the liquid refrigerant from the condenser, a first connection pipe connected to the condenser and in which the liquid refrigerant flows from the condenser, an indoor unit including a refrigerant inlet pipe connected to the first connection pipe and into which a capillary tube fully inserted into the refrigerant inlet pipe, and configured to expand the liquid refrigerant is fully inserted, an evaporator connected to the refrigerant inlet pipe to evaporate the refrigerant from the condenser, and a refrigerant outlet pipe in which the refrigerant discharged from the evaporator flows, and a second connection pipe connecting the refrigerant outlet pipe to the compressor, in which the refrigerant inlet pipe includes at least one bending portion that is bent together with the inserted capillary tube.

According to an embodiment of the disclosure, the capillary tube may include an expansion portion having an expanded diameter, and the air conditioning device may further include a clamping portion depressed a part of the refrigerant inlet pipe and a part of the expansion portion corresponding to the depressed part of the refrigerant inlet pipe to fix the capillary tube inside the refrigerant inlet pipe.

According to an embodiment of the disclosure, a buffering material may be arranged between the refrigerant inlet pipe and the capillary tube in the at least one bending portion.

According to an embodiment of the disclosure, the capillary tube may is made of a flexible material, and the air conditioning device may further include a shape retention pipe including a large-diameter portion, a small-diameter portion inserted into an end portion of the capillary tube, and a connection portion connecting the large-diameter portion to the small-diameter portion and a clamping portion depressed a part of the refrigerant inlet pipe and a part of the capillary tube in a position corresponding to the small-diameter portion to fix the capillary tube corresponding to the depressed part of the refrigerant inlet in a region corresponding to the small-diameter portion to fix the capillary tube inside the refrigerant inlet pipe.

According to an embodiment of the disclosure, the refrigerant inlet pipe may include a first portion connected to the evaporator and including the capillary tube inserted therein and a second portion connected to the first portion and provided with a first connection member connected to the first connection pipe in an end portion thereof, and a natural potential of the second portion may have a value between a natural potential of the first portion and a natural potential of the first connection member.

According to another embodiment of the disclosure, an air conditioning device includes a condenser configured to condense a refrigerant gas into a liquid refrigerant, a first connection pipe into which a refrigerant from the condenser flows, an evaporator configured to phase-change the liquid refrigerant introduced from the condenser into a vapor refrigerant, a refrigerant inlet pipe including a first portion connected to the evaporator and a second portion connected to the first portion and provided with a first connection member connected to the first connection pipe in an end portion thereof, and a capillary tube fully inserted into the first portion.

According to an embodiment of the disclosure, the capillary tube may include an expansion portion having an expanded diameter, and the air conditioning device may further include a clamping portion formed depressed in the refrigerant inlet pipe and the expansion portion to fix the capillary tube inside the refrigerant inlet pipe.

According to an embodiment of the disclosure, the capillary tube may include a flexible material, and the air conditioning device may further include a shape retention pipe including a large-diameter portion, a small-diameter portion inserted into the capillary tube, and a connection portion connecting the large-diameter portion to the small-diameter portion and a clamping portion formed depressed in the refrigerant inlet pipe and the capillary tube in a region corresponding to the small-diameter portion to fix the capillary tube inside the refrigerant inlet pipe.

According to an embodiment of the disclosure, the refrigerant inlet pipe may include at least one bending portion that is bent together with the capillary tube, and a buffering material may be arranged between the refrigerant inlet pipe and the capillary tube in the at least one bending portion.

According to an embodiment of the disclosure, a natural potential of the second portion may have a value between a natural potential of the first portion and a natural potential of the first connection member.

According to an embodiment of the disclosure, a buffering material is partially provided between the refrigerant inlet pipe and the capillary tube.

According to an embodiment of the disclosure, the buffering material is only provided between the refrigerant inlet pipe and the capillary tube in the at least one bending portion.

According to embodiments of the above-mentioned air conditioning device and indoor unit, expansion of a liquid refrigerant may occur in the indoor unit. Moreover, a capillary tube is fully inserted into a refrigerant inlet pipe, such that compact coupling between the capillary tube and the refrigerant inlet pipe may be possible and noise vibration caused by expansion of the liquid refrigerant may be reduced.

DETAILED DESCRIPTION

Figure 1:
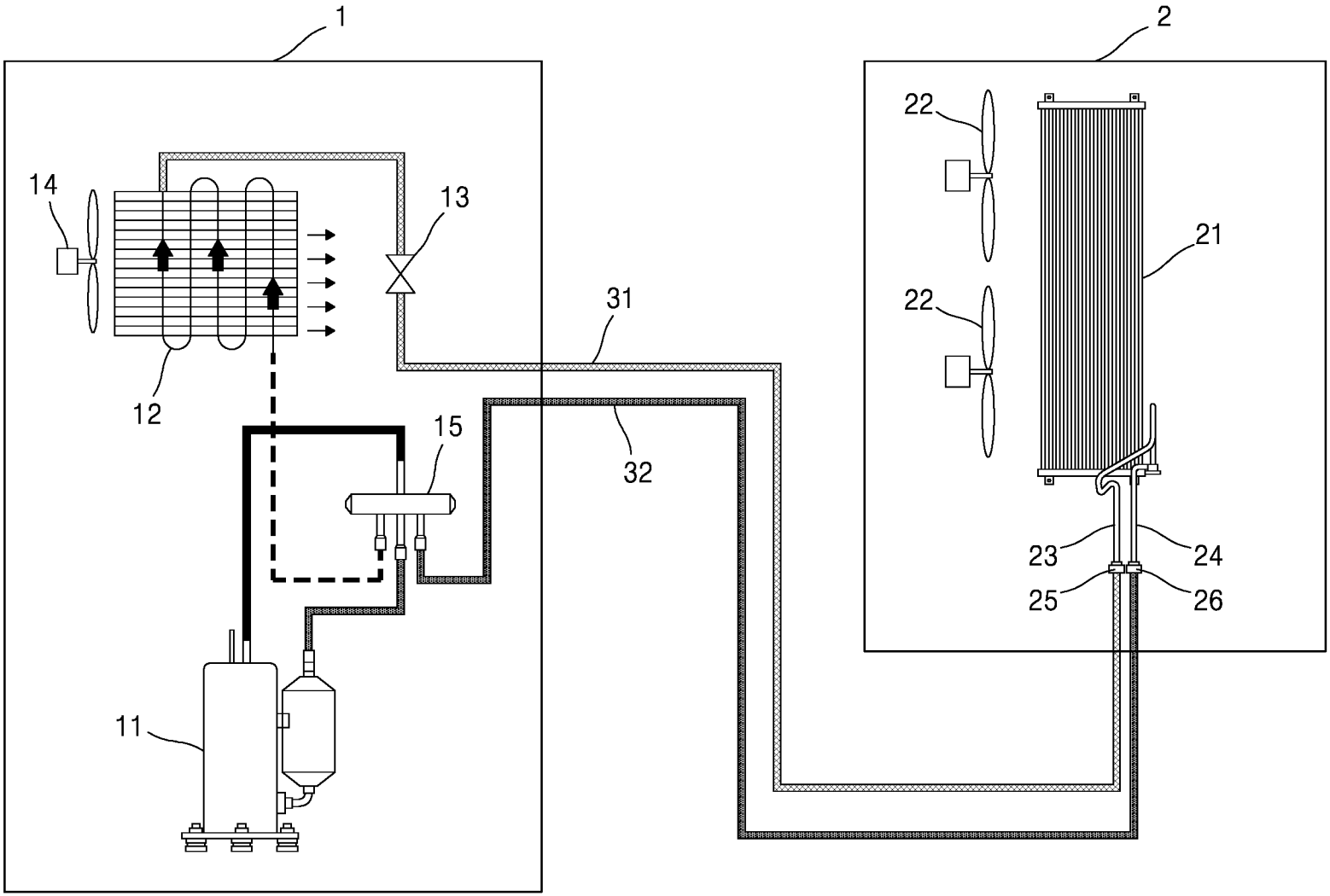
FIG. 1 is a schematic structural view of an air conditioning device according to an embodiment of the disclosure.

Throughout the disclosure, the expression "at least one of a, b or c" indicates only a, only b, only c, both a and b, both a and c, both b and . . . c, all of a, b, and c, or variations thereof.

Although terms used in embodiments of the disclosure are selected with general terms popularly used at present under the consideration of functions in the disclosure, the terms may vary according to the intention of those of ordinary skill in the art, judicial precedents, or introduction of new technology. In addition, in a specific case, the applicant voluntarily may select terms, and in this case, the meaning of the terms may be disclosed in a corresponding description part of an embodiment of the disclosure. Thus, the terms used in herein should be defined not by the simple names of the terms but by the meaning of the terms and the contents throughout the disclosure.

It is to be understood that the singular forms include plural references unless the context clearly dictates otherwise. All terms including technical or scientific terms used herein have the same meaning as commonly understood by those of ordinary skill in the art described herein.

Throughout the entirety of the specification of the disclosure, when it is assumed that a certain part includes a certain component, the term 'including' means that a corresponding component may further include other components unless specially described to the contrary. The term used herein such as "unit" or "module" indicates a unit for processing at least one function or operation, and may be implemented in hardware, software, or in a combination of hardware and software.

Expression used in the disclosure "~ configured to" may be exchangeably used with, for example, "~ suitable for", "~ having the capacity to", ~ designed to", "~ adapted to", "~ made to", or "~ capable of", depending on a situation. The term "~ configured to" may not necessarily mean "~ specially designed to" in terms of hardware. Instead, in a certain situation, the expression "a system configured to ~" may mean that the system is "capable of ~" together with other devices or parts.

Moreover, in the disclosure, when a component is mentioned as being "connected" or "coupled" to another component, it may be directly connected or directly coupled to the another component, but unless described otherwise, it should be understood that the component may also be connected or coupled to the another component via still another component therebetween.

Hereinafter, embodiments of the present disclosure will be described in detail with reference to the attached drawings to allow those of ordinary skill in the art to easily carry out the embodiments of the present disclosure. However, the disclosure may be implemented in various different forms, and are not limited to the embodiments of the disclosure described herein. Hereinafter, the embodiments of the disclosure will be described in detail with reference to the drawings.

Provided is an air conditioning device including a structure in which expansion of a liquid refrigerant occurs in an indoor unit. Provided is an air conditioning device including a compact coupling structure between a capillary tube where expansion of a liquid refrigerant occurs and a refrigerant inlet pipe of an evaporator. Provided is an air conditioning device including a structure capable of reducing noise vibration caused by expansion of a liquid refrigerant.

FIG. 1 is a schematic structural view of an air conditioning device according to an embodiment of the disclosure. Referring to FIG. 1, the air conditioning device may include a compressor 11, a condenser 12, and an evaporator 21. The compressor 11 may compress a low-pressure vapor refrigerant introduced from the evaporator 21 to a high-pressure vapor refrigerant. The condenser 12 may condense the vapor refrigerant introduced from the compressor 11 to a liquid refrigerant through heat exchange with the outdoor air. The condenser 12 may be connected to the evaporator 21 through a first connection pipe 31. The liquid refrigerant may be phase-changed to the vapor refrigerant in the evaporator 21. In this process, the temperature of the indoor air may be lowered by heat exchange between the indoor air and the evaporator 21.

The outdoor unit 1 may include the compressor 11 and the condenser 12. Reference numeral 14 may indicate an air blower that supplies heat exchange outdoor air to the condenser 12 for heat exchange. Reference numeral 13 may indicate a flow control valve that controls a flow rate of a refrigerant from the condenser 12. Reference numeral 15 may indicate a 4-way valve. A 4-way valve 15 may supply the low-pressure vapor refrigerant supplied from the evaporator 21 through a second connection pipe 32 to the compressor 11, and supply the high-pressure vapor refrigerant from the compressor 11 to the condenser 12. The indoor unit 2 may include the evaporator 21. Reference numeral 22 may indicate the air blower that supplies the indoor air to the evaporator 21 for heat exchange with the evaporator 21. Reference numeral 23 may indicate the refrigerant inlet pipe. A refrigerant inlet pipe 23 may be connected to the first connection pipe 31 by a first connection member 25, e.g., a nipple. Reference numeral 24 may indicate a refrigerant outlet pipe. A refrigerant outlet pipe 24 may be connected to the second connection pipe 32 by a second connection member 26, e.g., a nipple.

When an expansion valve instead of the valve (flow control valve) 13 is used, the liquid refrigerant may expand in the outdoor unit 1 and thus become a vapor-liquid mixed refrigerant (a two-phase refrigerant). The vapor-liquid mixed refrigerant may be supplied to the evaporator 21 through the first connection pipe 31 and the refrigerant inlet pipe 23. In this case, a flow noise may occur due to a flow disturbance factor of the first connection pipe 31, e.g., a change in a cross-sectional area of a flow path, bending of the flow path, etc. A measure to mount a flow rectifying filter that rectifies a flow pattern of the two-phase refrigerant on a front stage of the evaporator 21 may be considered, but in spite of this measure, the flow noise of the refrigerant may not be completely addressed, and the cost of the air conditioning device may be increased due to the expensive flow rectifying filter. As another measure, a capillary tube may be installed between the refrigerant inlet pipe 23 and the evaporator 21. However, according to this scheme, when there is no room in an internal space of the indoor unit 2, interference between the capillary tube and the evaporator 21 or another part inside the indoor unit 2 is inevitable, and anti-vibration rubber, etc., that fully surrounds the capillary tube to prevent a noise caused by vibration of the capillary tube or interference with another part needs to be applied, increasing the cost of the air conditioning device. Moreover, the capillary tube needs to be welded to the evaporator 21 and the refrigerant inlet pipe 23, increasing the complexity and cost of a manufacturing process.

The air conditioning device according to the disclosure may have a structure in which expansion of the liquid refrigerant occurs in the indoor unit 2. The air conditioning device according to the disclosure may adopt the capillary tube as a structure for expanding the liquid refrigerant. The capillary tube may be fully received in the refrigerant inlet pipe 23. According to such a structure, the liquid refrigerant flows in the first connection pipe 31, thus reducing and preventing a flow noise. In addition, the capillary tube is located in the refrigerant inlet pipe 23, such that interference with an internal part of the indoor unit 2 may not occur and noise caused by the interference may also be prevented. Hereinbelow, examples of a structure in which the capillary tube is installed in the refrigerant inlet pipe 23 will be described.

Figure 2:
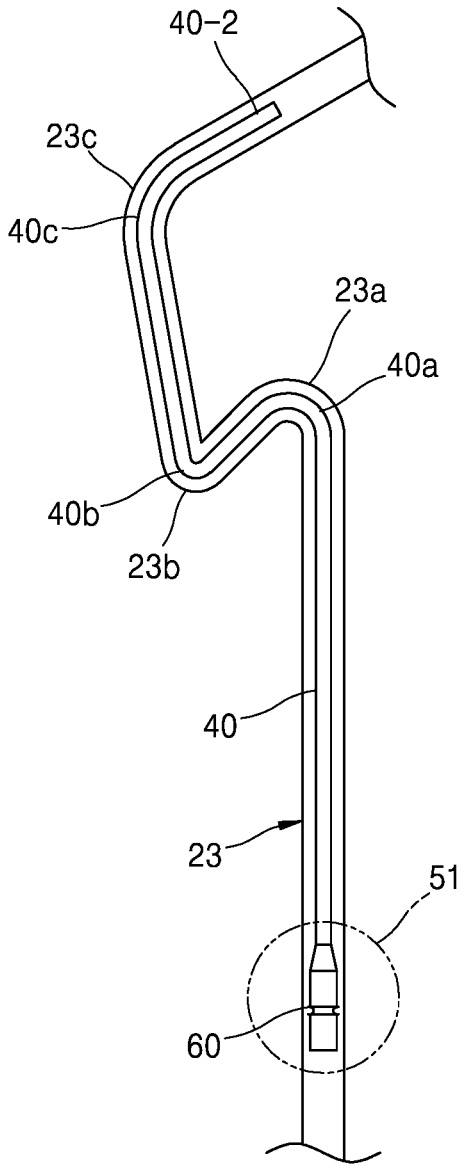
FIG. 2 is a schematic cross-sectional view of an example of a refrigerant inlet pipe including a capillary tube inserted therein.

FIG. 2 is a schematic cross-sectional view of an example of the refrigerant inlet pipe 23 including a capillary tube 40 inserted therein. Referring to FIG. 2, the capillary tube 40 may be fully inserted into the refrigerant inlet pipe 23. As a material of the capillary tube 40, a material capable of bend formation may be used. For example, the capillary tube 40 may be formed of a flexible material like a metal material such as aluminum, copper, stainless steel, etc., rubber, and the like. The capillary tube 40 may be inserted into the refrigerant inlet pipe 23 through an end portion of the refrigerant inlet pipe 23. For example, the refrigerant inlet pipe 23 in a straight pipe form and the capillary tube 40 in a straight pipe form may be provided, and the capillary tube 40 may be inserted into the refrigerant inlet pipe 23 through an end portion of the refrigerant inlet pipe 23.

A length of the capillary tube 40 may be greater than or equal to about 200 mm, and may be greater than or equal to, for example, 300 mm. The refrigerant inlet pipe 23 including the capillary tube 40 inserted therein may be received in a housing that forms the indoor unit 2. To effectively receive the refrigerant inlet pipe 23 in the indoor unit 2, the refrigerant inlet pipe 23 may include at least one bending portion. The refrigerant inlet pipe 23 may include at least one bending portion that is bent, together with the inserted capillary tube 40. The bending portion may include a portion including the capillary tube 40 inserted therein and a portion not including the capillary tube 40 inserted therein.

For example, the refrigerant inlet pipe 23 in a straight pipe form including the capillary tube 40 inserted therein may be provided. Next, depending on a need, a bending process such as bending of the refrigerant inlet pipe 23 may be performed to obtain the refrigerant inlet pipe 23 having a desired shape including the capillary tube 40 inserted therein. For example, the refrigerant inlet pipe 23 according to the current embodiment of the disclosure may include three bending portions 23*a*, 23*b*, and 23*c*. All of the three bending portions 23*a*, 23*b*, and 23*c* are portions including the capillary tube 40 inserted therein. Thus, the capillary tube 40 may also include three bending portions 40*a*, 40*b*, and 40*c*. The number of bending portions may not be limited to three. The refrigerant inlet pipe 23 may include an appropriate number of bending portions to form the refrigerant inlet pipe 23 including the capillary tube 40 inserted therein, in an appropriate shape for being received in the indoor unit 2 including the evaporator 21 and the air blower 22.

According to such a structure, the capillary tube 40 is globally inserted into the refrigerant inlet pipe 23, such that a structure for expanding the refrigerant may become compact. Thus, the utilization of the internal space of the indoor unit 2 may be improved, such that interference between a structure of the indoor unit 2 and the refrigerant inlet pipe 23 and a noise caused by the interference may be prevented. A liquid refrigerant flows in the first connection pipe 31, such that occurrence of a flow noise, caused by a flow disturbance factor of the first connection pipe 31, e.g., a change in a cross-sectional area of a flow path, bending of the flow path, etc., may be reduced or prevented. Moreover, a structure where the capillary tube 40 is globally inserted into the refrigerant inlet pipe 23 and has at least one bending portion may be effectively applied to the indoor unit 2 having a small internal space due to space constraints.

Figure 3:
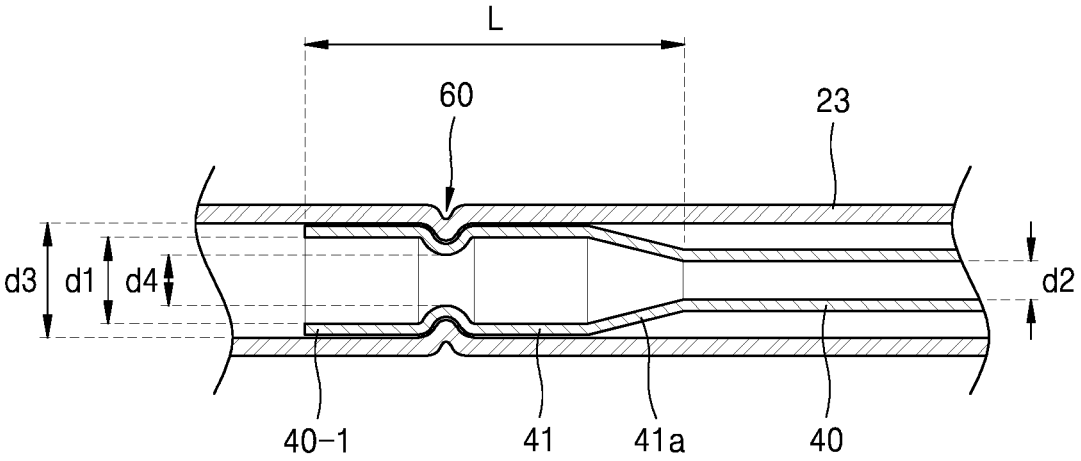
FIG. 3 is a detailed cross-sectional view of a portion indicated by reference numeral 51 in FIG. 2.

For example, the capillary tube 40 may be a metal pipe. At least one spot of the capillary tube 40 may be fixed to the refrigerant inlet pipe 23. With the air conditioning device according to the disclosure, the capillary tube 40 may be fixed to the refrigerant inlet pipe 23 by clamping processing. For example, based on a flow direction of the refrigerant, a clamping portion 60 may be provided to fix the capillary tube 40 to the refrigerant inlet pipe 23 around an upstream end portion 40-1 of the capillary tube 40. FIG. 3 is a detailed cross-sectional view of a portion indicated by 51 of FIG. 2. Referring to FIG. 3, the clamping portion 60 may be formed depressed in the refrigerant inlet pipe 23 and the capillary tube 40. For example, the clamping portion 60 may be formed by partially compressing the refrigerant inlet pipe 23 and the capillary tube 40 to form a depressed portion with a partially reduced diameter. The clamping portion 60 is depressed a part of the refrigerant inlet pipe 23 and a part of the capillary tube 40 corresponding to the depressed part of the refrigerant inlet pipe 23. According to such a structure, the capillary tube 40 may be fixed to the refrigerant inlet pipe 23 without a welding process, thus simplifying a manufacturing process and reducing a processing cost.

Moreover, a welding defect in a welding process, a defect such as introduction of a welding material to the refrigerant inlet pipe 23 or the capillary tube 40, etc., may not occur, thereby improving a manufacturing yield of the air conditioning device. In the embodiment of the disclosure shown in FIG. 2, the clamping portion 60 may be formed in the upstream end portion 40-1 of the capillary tube 40, but a position of the clamping portion 60 may not be limited thereto. The clamping portion 60 may be formed in various positions such as in a downstream end portion 40-2 of the capillary tube 40, in the upstream end portion 40-1 and the downstream end portion 40-2, between the upstream end portion 40-1 and the downstream end portion 40-2, etc.

In a part where the clamping portion 60 is formed, a structure for preventing an inner diameter of the capillary tube 40 from being excessively reduced may be required. Referring back to FIG. 3, an expansion portion 41 with an expanded diameter may be provided in the end portion 40-1 of the capillary tube 40. An inner diameter d1 of the expansion portion 41 may be greater than an inner diameter d2 of the capillary tube 40, and an outer diameter of the expansion portion 41 may be less than an inner diameter d3 of the refrigerant inlet pipe 23. The clamping portion 60 may be provided in the expansion portion 41. That is, the clamping portion 60 may be formed by partially compressing the refrigerant inlet pipe 23 and the expansion portion 41 to form a depressed portion with a reduced diameter. After depressed by the clamping portion 60, the inner diameter d4 of the expansion portion 41 may be greater than or equal to the inner diameter d2 of the capillary tube 40. According to such a structure, a refrigerant flow resistance in the capillary tube 40 may be prevented from being increased. Although not shown, the expansion portion 41 may be provided in the downstream end portion 40-2 of the capillary tube 40.

For example, the inner diameter d2 of the capillary tube 40 may be about 1.7-about 2.2 mm. In the current embodiment of the disclosure, the inner diameter d2 of the capillary tube 40 may be about 2 mm, and the inner diameter d3 of the refrigerant inlet pipe 23 may be about 6 mm. The outer diameter of the expansion portion 41 may be slightly less than the diameter d3 of the refrigerant inlet pipe 23. The outer diameter of the expansion portion 41 may be slightly greater than the inner diameter d3 of the refrigerant inlet pipe 23 such that the expansion portion 41 may be forcedly inserted into the refrigerant inlet pipe 23. As a wall thickness decreases in formation of the expansion portion 41, the wall may be damaged as a length L of the expansion portion 41 increases. For example, a damage may occur in a slope connection portion 41*a* that connects the capillary tube 40 with the expansion portion 41. As the length L of the expansion portion 41 increases, the clamping portion 60 may be formed in a plurality of spots. As the length of the capillary tube 40 decreases, the inner diameter d2 of the capillary tube 40 may decrease to obtain an expansion effect. That is, for the capillary tube 40 of a long length, the capillary tube 40 having a relatively large inner diameter d2 may be used, and in this case, the wall thickness of the capillary tube 40 may also increase. When the capillary tube 40 having a large wall thickness is used, the length L of the expansion portion 41 may be long. The current embodiment of the disclosure may employ a structure where the capillary tube 40 having a length of about 200 mm or more, e.g., about 300 mm or more, is fully inserted into the refrigerant inlet pipe 23. Thus, the capillary tube 40 having the inner diameter d2 of, e.g., about 2 mm, may be used. In this case, the outer diameter of the capillary tube 40 may be, for example, about 3.25 mm. That is, the wall thickness of the capillary tube 40 may be about 0.625 mm. Thus, by increasing the length L of the expansion portion 41, the number of clamping portions 60 may be increased. While one clamping portion 60 is formed in the expansion portion 41 in FIG. 3, two or more clamping portions 60 may be formed in the expansion portion 41 depending on a need.

Figure 4:
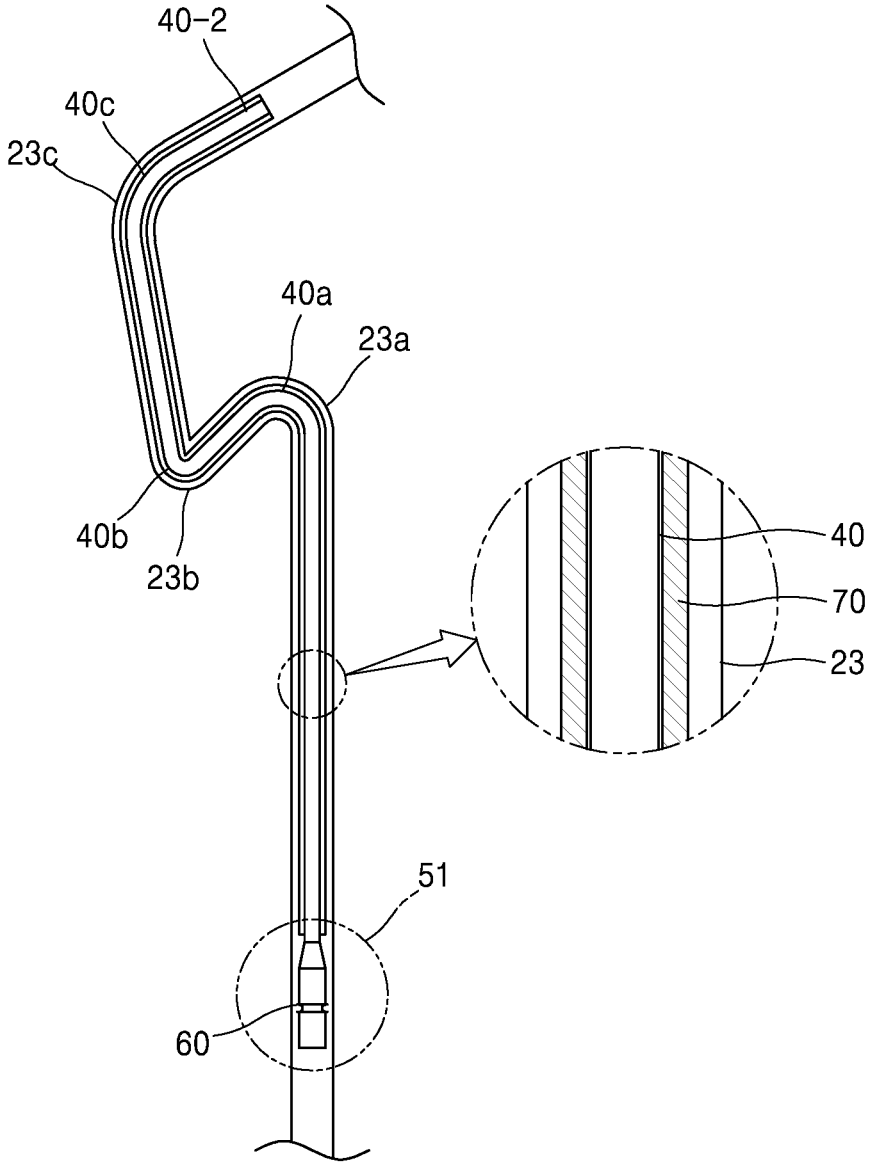
FIG. 4 is a schematic cross-sectional view of an example of a refrigerant inlet pipe including a capillary tube inserted therein.

FIG. 4 is a schematic cross-sectional view of an example of the refrigerant inlet pipe 23 including the capillary tube 40 inserted therein. Referring to FIG. 4, the capillary tube 40 may be fully inserted into the refrigerant inlet pipe 23. The expansion portion 41 may be provided in the upstream end portion 40-1 of the capillary tube 40. The capillary tube 40 may be coupled to the refrigerant inlet pipe 23 by the clamping portion 60 provided in the refrigerant inlet pipe 23 and the expansion portion 41. A buffering material 70 may be arranged between the refrigerant inlet pipe 23 and the capillary tube 40. In the current embodiment of the disclosure, the buffering material 70 may be arranged between the capillary tube 40 and the refrigerant inlet pipe 23 in the entire region between the both end portions 40-1 and 40-2 of the capillary tube 40. The buffering material 70 may be implemented by a material having a noise blocking effect, an attenuation effect, etc., e.g., rubber, fabrics, etc.

For example, the refrigerant inlet pipe 23 in the straight-line shape and the capillary tube 40 in the straight-line shape may be provided. The buffering material 70 may surround the outer circumference of the capillary tube 40 to a certain thickness. For example, the buffering material 70 in a fabric shape or a rubber band shape may surround the outer circumference of the capillary tube 40.

The outer diameter of the capillary tube 40 to which the buffering material 70 is applied may be less than the inner diameter of the refrigerant inlet pipe 23. Next, the capillary tube 40 to which the buffering material 70 is applied may be inserted into the refrigerant inlet pipe 23 through an end portion of the refrigerant inlet pipe 23. Next, depending on a need, a bending process such as bending of the refrigerant inlet pipe 23 may be performed to obtain the refrigerant inlet pipe 23 including the capillary tube 40 inserted therein and having the buffering material 700 between the refrigerant inlet pipe 23 and the capillary tube 40.

In a related structure where a capillary tube is arranged between the refrigerant inlet pipe 23 and the evaporator 21, a buffering material may fully surround the exterior of the capillary tube, resulting in a large volume of the buffering material. According to an embodiment of the disclosure, the buffering material 70 may be arranged between the capillary tube 40 and the refrigerant inlet pipe 23 and the capillary tube 40 including the buffering material 70 may be fully inserted in the refrigerant inlet pipe 23. Thus, the volume of the buffering material 70 may be relatively small, reducing the material cost. Moreover, due to a triple anti-vibration structure of the refrigerant inlet pipe 23, the buffering material 70, and the capillary tube 40, vibration and noise, caused by flow of the refrigerant in the capillary tube 40, may be effectively attenuated.

Figure 5:
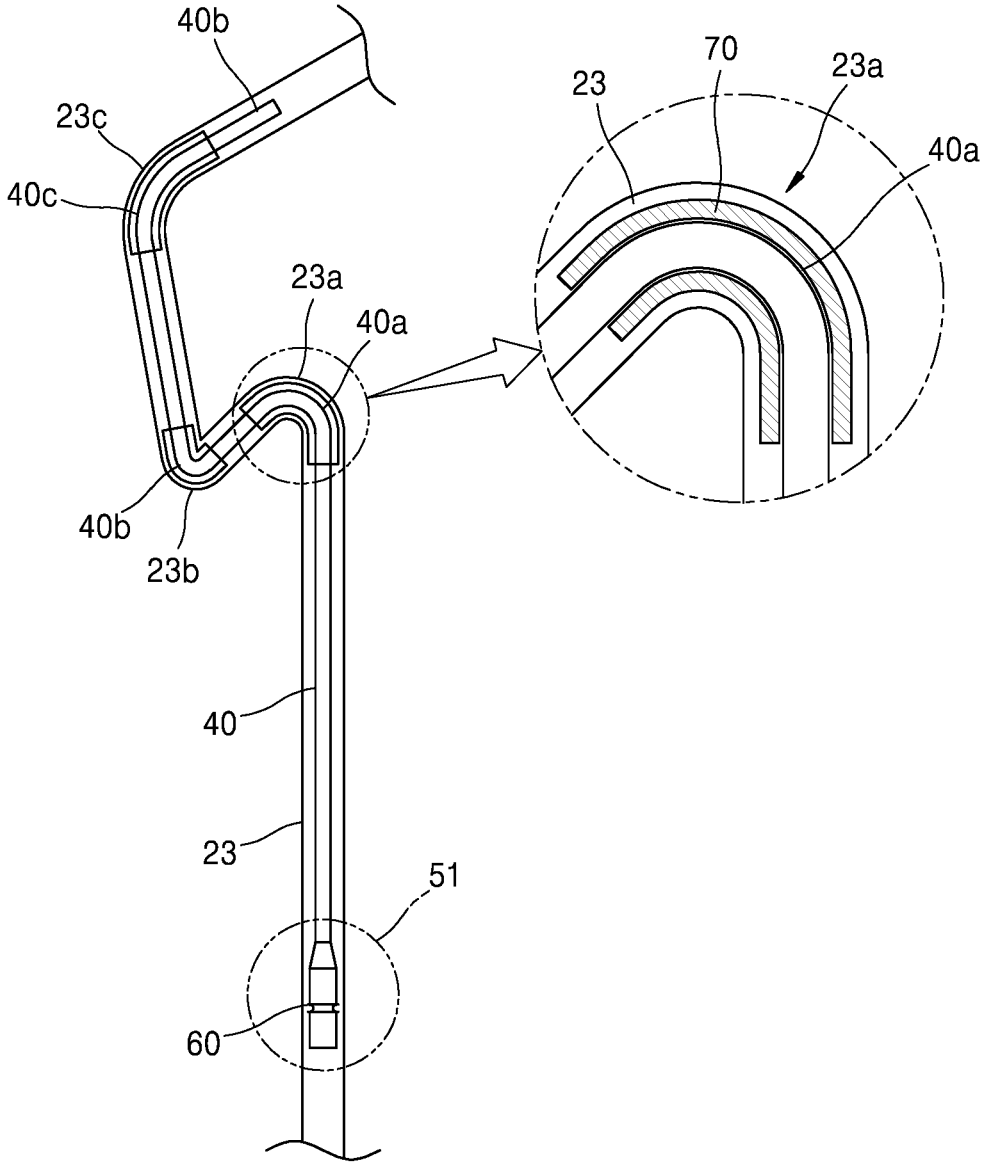
FIG. 5 is a schematic cross-sectional view of an example of a refrigerant inlet pipe including a capillary tube inserted therein.

FIG. 5 is a schematic cross-sectional view of an example of the refrigerant inlet pipe 23 including the capillary tube 40 inserted therein. Referring to FIG. 5, the capillary tube 40 may be fully inserted into the refrigerant inlet pipe 23. The expansion portion 41 may be provided in the upstream end portion 40-1 of the capillary tube 40. The capillary tube 40 may be coupled to the refrigerant inlet pipe 23 by the clamping portion 60 provided in the refrigerant inlet pipe 23 and the expansion portion 41. The refrigerant inlet pipe 23 may include at least one bent bending portion. For example, the refrigerant inlet pipe 23 according to the current embodiment of the disclosure may include three bending portions 23*a*, 23*b*, and 23*c*. The buffering material 70 may be arranged between the refrigerant inlet pipe 23 and the capillary tube 40 in the bending portions 23*a*, 23*b*, and 23*c*. The buffering material 70 may be implemented by a material having a noise blocking effect, an attenuation effect, etc., e.g., rubber, fabrics, etc.

For example, the refrigerant inlet pipe 23 in the straight-line shape and the capillary tube 40 in the straight-line shape may be provided. A position corresponding to the bending portions 23*a*, 23*b*, and 23*c* in the outer circumference of the capillary tube 40 is surrounded by the buffering material 70 to a certain thickness. For example, the buffering material 70 in a fabric shape or a rubber band shape may be wound around the position corresponding to the bending portions 23*a*, 23*b*, and 23*c* in the outer circumference of the capillary tube 40. The outer diameter of the capillary tube 40 to which the buffering material 70 is applied may be less than the inner diameter of the refrigerant inlet pipe 23. Next, the capillary tube 40 to which the buffering material 70 is applied may be inserted into the refrigerant inlet pipe 23 through an end portion of the refrigerant inlet pipe 23. The refrigerant inlet pipe 23 may then be bent by a bending process to form the bending portions 23*a*, 23*b*, and 23*c*. In the capillary tube 40, bending portions 40*a*, 40*b*, and 40*c* respectively corresponding to the bending portions 23*a*, 23*b*, and 23*c* of the refrigerant inlet pipe 23 may be formed. In this way, the refrigerant inlet pipe 23 may be obtained which includes the capillary tube 40 inserted therein, which has a structure where the buffering material 70 is between the capillary tube 40 and the refrigerant inlet pipe 23 in the bending portions 23*a*, 23*b*, and 23*c*.

A refrigerant flow condition in the capillary tube 40 changes in the bending portions 23*a*, 23*b*, and 23*c*, such that vibration and a noise are highly likely to occur in the bending portions 23*a*, 23*b*, and 23*c*. According to the current embodiment of the disclosure, by selectively applying the buffering material 70 to the bending portions 23*a*, 23*b*, and 23*c*, the volume of the buffering material 70 may be reduced while attenuating vibration and a noise, thereby reducing the material cost.

Figure 6:
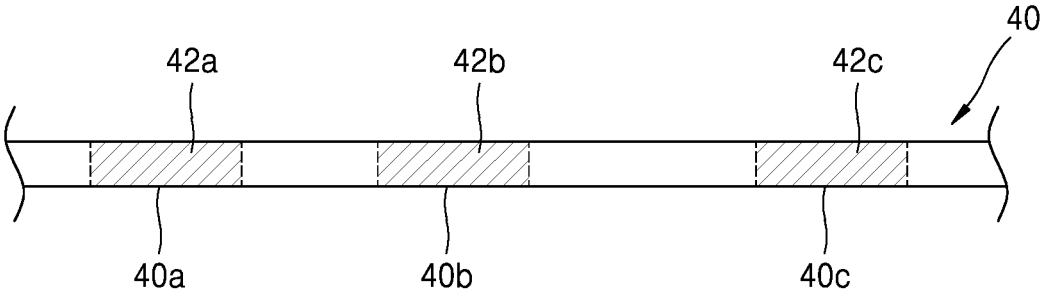
FIG. 6 is a schematic view of an example of a capillary tube.

FIG. 6 is a schematic view of an example of the capillary tube 40. Referring to FIG. 6, an indication portion may be provided in the outer circumference of the capillary tube 40 to indicate a position in which the buffering material 70 is to be installed. According to an embodiment of the disclosure, the indication portion may correspond to a bending portion of the refrigerant inlet pipe 23. For example, indication portions 42*a*, 42*b*, and 42*c* respectively corresponding to the bending portions 23*a*, 23*b*, and 23*c* of the refrigerant inlet pipe 23 may be provided in the outer circumference of the capillary tube 40. While the indication portions 42*a*, 42*b*, and 42*c* are shown as slant lines, their forms are not specially limited. The indication portions 42*a*, 42*b*, and 42*c* may be in any form that indicates a position where the buffering material 70 is to be installed. For example, the indication portions 42*a*, 42*b*, and 42*c* may be formed by printing, carving, etc.

Figure 7:
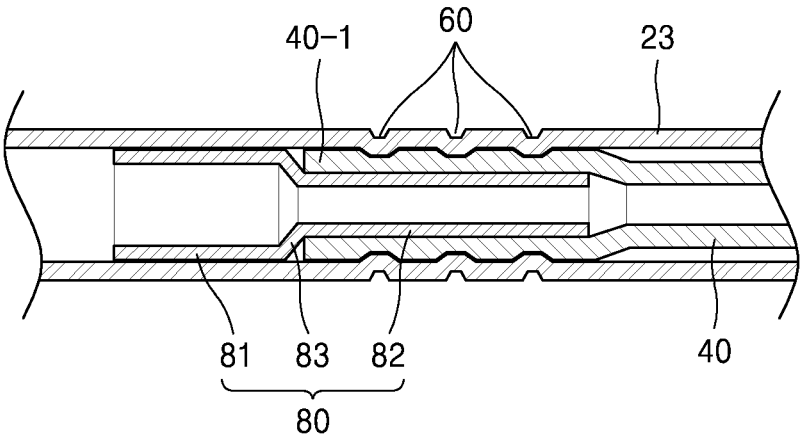
FIG. 7 is a schematic cross-sectional view of an example of a refrigerant inlet pipe including a capillary tube inserted therein.

The capillary tube 40 may be formed of a flexible material such as rubber, etc. It may not be easy to form the above-described expansion portion 41 in the capillary tube 40 formed of a flexible material such as rubber, etc. When the clamping portion 60 is formed in the capillary tube 40 formed of the flexible material such as rubber, etc., the inner diameter of the capillary tube 40 may be reduced, such that refrigerant flow resistance and corresponding vibration and noise may occur. FIG. 7 is a schematic cross-sectional view of an example of the refrigerant inlet pipe 23 including the capillary tube 40 inserted therein. Referring to FIG. 7, a shape retention pipe 80 may be inserted into an end portion of the capillary tube 40, e.g., the downstream end portion 40-1. The shape retention pipe 80 may be formed of a hard material when compared to the capillary tube 40. For example, the shape retention pipe 80 may be a metal pipe. The metal pipe may be formed of, e.g., copper, aluminum, stainless steel, etc. The clamping portion 60 may be formed depressed in the refrigerant inlet pipe 23 and the capillary tube 40 in a position where the shape retention pipe 80 is arranged, and the capillary tube 40 may be fixed to the inside of the refrigerant inlet pipe 23.

The shape retention pipe 80 may include, for example, a large-diameter portion 81, a small-diameter portion 82 inserted into the capillary tube 40, and a connection portion 83 that connects the large-diameter portion 81 with the small-diameter portion 82. An outer diameter of the large-diameter portion 81 may be less than an inner diameter of the refrigerant inlet pipe 23, and may be greater than an inner diameter of the capillary tube 40. The large-diameter portion 81 is inserted into the refrigerant inlet pipe 23, and contacts an inner side of the refrigerant inlet pipe 23. An outer diameter of the small-diameter portion 82 may be greater than the inner diameter of the capillary tube 40 such that the small-diameter portion 82 may be forcedly inserted into the end portion 40-1 of the capillary tube 40. The inner diameter of the small-diameter portion 82 may be equal to the inner diameter of the capillary tube 40. The clamping portion 60 may be formed in a corresponding region of the small-diameter portion 82. The small-diameter portion 82 of the shape retention pipe 80 may support the end portion 40-1 of the capillary tube 40 therein to prevent the end portion 40-1 of the capillary tube 40 from being narrowed. Thus, an outer circumferential portion of the end portion 40-1 of the capillary tube 40 may be partially depressed, but an inner circumferential portion of the end portion 40-1 may be supported in the small-diameter portion 82 of the shape retention pipe 80 and thus may not be depressed. Therefore, the inner diameter of the capillary tube 40 may be maintained fully uniform, thereby preventing a refrigerant flow resistance and corresponding vibration and noise.

Figure 8:
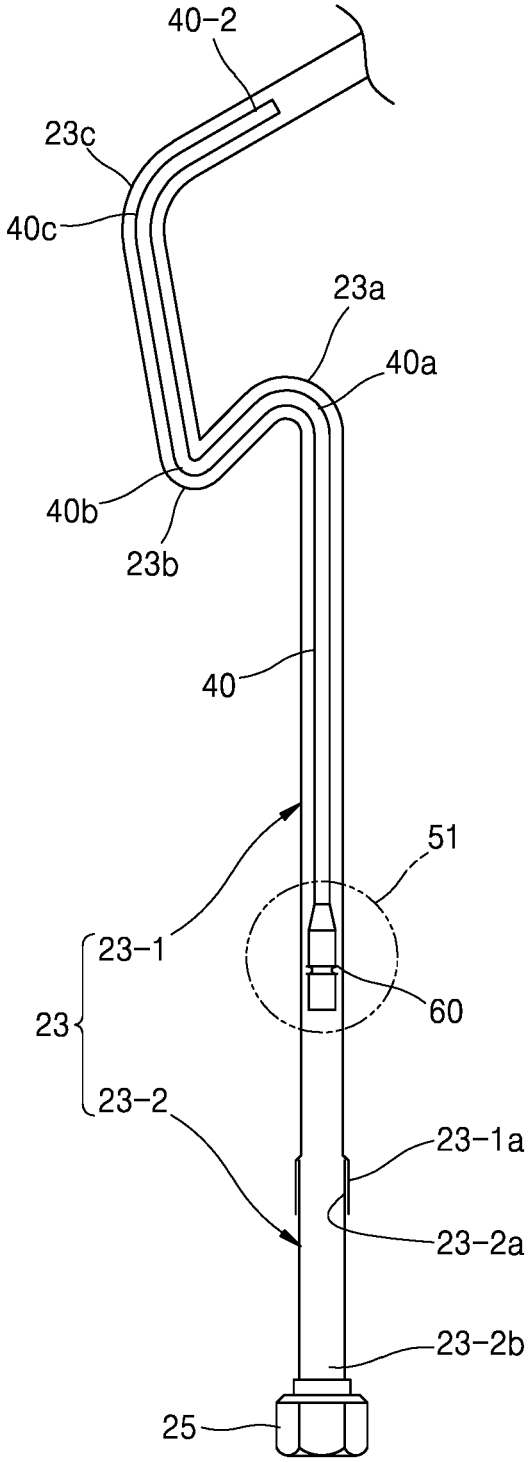
FIG. 8 is a schematic cross-sectional view of an example of a refrigerant inlet pipe including a capillary tube inserted therein.

FIG. 8 is a schematic cross-sectional view of an example of the refrigerant inlet pipe 23 including the capillary tube 40 inserted therein. Referring to FIG. 8, the refrigerant inlet pipe 23 may include a first portion 23-1 and a second portion 23-2. The capillary tube 40 may be inserted in the first portion 23-1. An inserted structure of the capillary tube 40 may be as described with reference to FIGS. 2 to 7. The first portion 23-1 may be connected to the evaporator 21. The first portion 23-1 and the second portion 23-2 may be interconnected, for example, by welding. An end portion 23-1*a* of the first portion 23-1 and an end portion 23-2*a* of the second portion 23-2 may be welded to each other. For example, an expansion shape portion may be provided in the end portion 23-1*a* of the first portion 23-1, and the end portion 23-2*a* of the second portion 23-2 may be inserted into the expansion shape portion. In this state, the end 23-1*a* of the first portion 23-1 and the end portion 23-2*a* of the second portion 23-2 may be welded to each other. The first connection member 25 may be provided in an end portion 23-2*b* of the second portion 23-2. The first connection member 25 may be a nipple that connects the first connection pipe 31 where the refrigerant flows from the condenser 12 with the refrigerant inlet pipe 23.

The first portion. 23-1 may be formed of the same material as the evaporator 21. For example, the first portion 23-1 may be formed of aluminum or an aluminum alloy. The first connection member 25, e.g., the nipple may be formed of brass. The second portion 23-2 may be formed of a material that is different from the first portion 23-1. For example, the second portion 23-2 may be formed of metal having a natural potential lower than that of the first portion 23-1 and higher than that of the first connection member 25.

Generally, when two metals contact and are exposed to a corrosion environment, the metal having the low natural potential among the two metals may be an anode, the other metal may be a cathode, and electrons move between them, such that the anode is corroded. As a potential difference between the two metals increases, an anode metal is corroded faster. Such corrosion is referred to as galvanic corrosion. For example, a natural potential of aluminum may be about −1.66 V, and a natural potential of copper may be about +0.38 V. Thus, when aluminum or an aluminum alloy and brass are in contact with each other, the aluminum or the aluminum alloy with the lower natural potential may be corroded faster.

Taking this into account, the refrigerant inlet pipe 23 according to the current embodiment of the disclosure may include the second portion 23-2 between the first portion 23-1 and the first connection member 25. The natural potential of the second portion 23-2 may have a value between the natural potential of the first portion 23-1 and the natural potential of the first connection member 25. For example, the second portion 23-2 may be formed of metal having a natural potential higher than that of the first portion 23-1 and lower than that of the first connection member 25. For example, the second portion 23-2 may be formed of stainless steel. With this structure, a potential difference between the first portion 23-1 and the second portion 23-2 and a potential difference between the second portion 23-2 and the first connection member 25 may be reduced, thereby lowering corrosion possibility and corrosion speed of the first portion 23-1 and the evaporator 21.

While embodiments of the disclosure have been described by the limited embodiments and drawings, various modifications and changes may be made from the disclosure by those of ordinary skill in the art. In addition, the scope of the disclosure may not be limited thereto, and various modification and improvement forms of those of ordinary skill in the art using the basic concept of the disclosure defined in the following claims fall in the right range of the disclosure.

What is claimed is:

1. An air conditioning device comprising:

a condenser configured to condense a refrigerant gas into a liquid refrigerant;

an evaporator configured to phase-change the liquid refrigerant introduced from the condenser into a vapor refrigerant;

a refrigerant inlet pipe connected to the evaporator and into which a refrigerant is introduced from the condenser;

a capillary tube fully inserted into the refrigerant inlet pipe; and a clamping portion depressed a part of the refrigerant inlet pipe and a part of the capillary tube corresponding to the depressed part of the refrigerant inlet pipe to fix the capillary tube inside the refrigerant inlet pipe.

2. The air conditioning device of claim 1, wherein the capillary tube comprises an expansion portion having an expanded diameter, and the expansion portion includes the depressed part of the capillary tube which corresponds to the depressed part of the clamping portion.

3. The air conditioning device of claim 2, wherein an inner diameter of the depressed part of the expansion portion which is depressed by the clamping portion is greater than or equal to an inner diameter of the capillary tube.

4. The air conditioning device of claim 1, further comprising a buffering material arranged between the refrigerant inlet pipe and the capillary tube.

5. The air conditioning device of claim 1, wherein the refrigerant inlet pipe comprises at least one bending portion that is bent together with the capillary tube.

6. The air conditioning device of claim 5, further comprising a buffering material arranged between the refrigerant inlet pipe and the capillary tube in the at least one bending portion.

7. The air conditioning device of claim 1, wherein the capillary tube is made of a flexible material.

8. The air conditioning device of claim 7, further comprising a shape retention pipe comprising:

a large-diameter portion inserted into the refrigerant inlet pipe, and contacting an inner side of the refrigerant inlet pipe;

a small-diameter portion inserted into an end portion of the capillary tube to fix the capillary tube to the inner side of the refrigerant inlet pipe; and a connection portion connecting the large-diameter portion to the small-diameter portion, wherein the depressed part of the refrigerant inlet pipe and the depressed part of the capillary tube are in a position corresponding to the small-diameter portion to fix the capillary tube inside the refrigerant inlet pipe.

9. The air conditioning device of claim 1, wherein the refrigerant inlet pipe comprises a first portion comprising the capillary tube inserted therein, and a second portion connected to the first portion and provided with a first connection member connected to a first connection pipe into which a refrigerant from the condenser flows.

10. The air conditioning device of claim 9, wherein a natural potential of the second portion has a value between a natural potential of the first portion and a natural potential of the first connection member.

11. An air conditioning device comprising:

an outdoor unit comprising:

a compressor configured to compress a vapor refrigerant to a high-pressure vapor refrigerant;

a condenser configured to condense the compressed high-pressure vapor refrigerant to a liquid refrigerant; and a flow control valve configured to control a flow rate of the liquid refrigerant from the condenser;

a first connection pipe connected to the condenser and into which the liquid refrigerant flows from the condenser;

an indoor unit comprising:

a refrigerant inlet pipe connected to the first connection pipe;

a capillary tube fully inserted into the refrigerant inlet pipe, and configured to expand the liquid refrigerant, the capillary tube comprising an expansion portion having an expanded diameter;

an evaporator connected to the refrigerant inlet pipe to evaporate the refrigerant from the condenser; and a refrigerant outlet pipe in which the refrigerant discharged from the evaporator flows;

a second connection pipe connecting the refrigerant outlet pipe to the compressor-; and a clamping portion depressed a part of the refrigerant inlet pipe and a part of the expansion portion corresponding to the depressed part of the refrigerant inlet pipe to fix the capillary tube inside the refrigerant inlet pipe;

wherein the refrigerant inlet pipe comprises at least one bending portion that is bent together with the inserted capillary tube.

12. The air conditioning device of claim 11, wherein a buffering material is between the refrigerant inlet pipe and the capillary tube in the at least one bending portion.

13. The air conditioning device of claim 11, further comprising:

a shape retention pipe comprising:

a large-diameter portion;

a small-diameter portion inserted into the capillary tube; and a connection portion connecting the large-diameter portion to the small-diameter portion, wherein the capillary tube is made of a flexible material, and the clamping portion is depressed the part of the refrigerant inlet pipe and the part of the capillary tube corresponding to the depressed part of the refrigerant inlet in a region corresponding to the small-diameter portion to fix the capillary tube inside the refrigerant inlet pipe.

14. The air conditioning device of claim 11, wherein the refrigerant inlet pipe comprises a first portion connected to the evaporator and comprising the capillary tube inserted therein, and a second portion connected to the first portion and provided with a first connection member connected to the first connection pipe in an end portion thereof, and a natural potential of the second portion has a value between a natural potential of the first portion and a natural potential of the first connection member.

15. An air conditioning device comprising:

a condenser configured to condense a refrigerant gas into a liquid refrigerant;

a first connection pipe into which a refrigerant from the condenser flows;

an evaporator configured to phase-change the liquid refrigerant introduced from the condenser into a vapor refrigerant;

a refrigerant inlet pipe comprising a first portion connected to the evaporator and a second portion connected to the first portion and provided with a first connection member connected to the first connection pipe in an end portion thereof;

a capillary tube fully inserted into the first portion, the capillary tube comprising an expansion portion having an expanded diameter; and a clamping portion formed depressed in the refrigerant inlet pipe and the expansion portion to fix the capillary tube inside the refrigerant inlet pipe.

16. The air conditioning device of claim 15, further comprising:

a shape retention pipe comprising:

a large-diameter portion;

a small-diameter portion inserted into the capillary tube; and a connection portion connecting the large-diameter portion to the small-diameter portion, wherein the capillary tube is made of a flexible material, and the clamping portion is depressed in the refrigerant inlet pipe and the capillary tube in a region corresponding to the small-diameter portion to fix the capillary tube inside the refrigerant inlet pipe.

17. The air conditioning device of claim 15, wherein the refrigerant inlet pipe comprises at least one bending portion that is bent together with the capillary tube, and a buffering material is between the refrigerant inlet pipe and the capillary tube in the at least one bending portion.

18. The air conditioning device of claim 15, wherein a natural potential of the second portion has a value between a natural potential of the first portion and a natural potential of the first connection member.

* * * * *